United States Patent [19]

Tsuji

[11] Patent Number: 4,523,665

[45] Date of Patent: Jun. 18, 1985

[54] CONTROL APPARATUS FOR ELEVATORS

[75] Inventor: Shintaro Tsuji, Nagoya, Japan

[73] Assignee: Mitsubishi Denki Kabushiki Kaisha, Japan

[21] Appl. No.: 560,949

[22] Filed: Dec. 13, 1983

[30] Foreign Application Priority Data

Dec. 18, 1982 [JP] Japan ..... 57-222557

[51] Int. Cl.[3] ..... B66B 1/20

[52] U.S. Cl. ..... 187/29 R

[58] Field of Search ..... 187/29, 29 R

[56] References Cited

U.S. PATENT DOCUMENTS

| | | | |
|---|---|---|---|
| 3,593,825 | 7/1971 | Gieseler | 187/29 R |
| 4,044,860 | 8/1977 | Kaneko et al. | 187/29 R |
| 4,084,661 | 4/1978 | Quan et al. | 187/29 R |
| 4,410,959 | 10/1983 | Tajima et al. | 187/29 R X |
| 4,411,338 | 10/1983 | Kuzunuki et al. | 187/29 R |
| 4,458,787 | 7/1984 | Uetani | 187/29 R |

FOREIGN PATENT DOCUMENTS

| | | | |
|---|---|---|---|
| 2115578 | 9/1983 | United Kingdom | 187/29 |

*Primary Examiner*—Vit W. Miska
*Assistant Examiner*—Paul Shik Luen Ip
*Attorney, Agent, or Firm*—Leydig, Voit, Osann, Mayer and Holt, Ltd.

[57] ABSTRACT

A control apparatus for elevators in which one cycle of a fluctuating demand is divided into a plurality of sections, the demand in each section or a service condition value of the elevators for the demand is measured, the demand or the service condition value of the corresponding section is estimated from the measured value, and decision means is comprised to compare the estimated value and the measured value obtained anew and to decide the compared result, so that when the compared result has been decided to fail in satisfying a reference condition, cages are controlled with a value set separately from the estimated value or a value separately calculated for estimation. This brings forth the effect that, even when the measured value has become different from an ordinary value due to the occurrence of a special traffic condition, it is not used for the calculation of the estimative value, so as to permit an accurate estimation when an ordinary traffic condition has been thereafter restored.

9 Claims, 10 Drawing Figures

FIG. 4

33

| | |
|---|---|
| 41 | TIME |
| 42 | LDU |
| 43 | LDD |
| 44 | J |
| 45 | X |
| 46 | FLAG |
| 47 | PU(1) |
| 48 | PU(2) |
| 49 | PU(3) |
| 50 | PD(1) |
| 51 | PD(2) |
| 52 | PD(3) |
| 53 | PUL(1) |
| 54 | PUL(2) |
| 55 | PUL(3) |
| 56 | PDL(1) |
| 57 | PDL(2) |
| 58 | PDL(3) |
| 59 | PUX(1) |
| 60 | PUX(2) |
| 61 | PUX(3) |
| 62 | PDX(1) |
| 63 | PDX(2) |
| 64 | PDX(3) |

FIG. 5

34

| | |
|---|---|
| 71 | T1 |
| 72 | T2 |
| 73 | T3 |
| 74 | T4 |
| 75 | SA |
| 76 | L |
| 77 | PU1 |
| 78 | PU2 |
| 79 | PU3 |
| 80 | PD1 |
| 81 | PD2 |
| 82 | PD3 |
| 83 | PU1X |
| 84 | PU2X |
| 85 | PU3X |
| 86 | PD1X |
| 87 | PD2X |
| 88 | PD3X |

ENTER
TIME = T1 ?
131
YES
NO
TIME = T2 ?
133
YES
NO
TIME = T3 ?
137
YES
NO
TIME = T4 ?
139
NO
YES
140
X ← {PUL(3)−PU(3)}² + {PDL(3)−PD(3)}²
138
X ← {PUL(2)−PU(2)}² + {PDL(2)−PD(2)}²
134
X ← {PUL(1)−PU(1)}² + {PDL(1)−PD(1)}²
135
X ≧ L ?
NO
YES
136
FLAG ← 1
132
FLAG ← 0
95A
TIME = T4 ?
141
NO
YES
FLAG = 1 ?
142
YES
NO
J ← 1
143
J ← 1
147
144
PUL(J) ← (1−SA)×PUL(J) + SA×PU(J)
PDL(J) ← (1−SA)×PDL(J) + SA×PD(J)
146
J ← J+1
148
PUX(J) ← (1−SA)×PUX(J) + SA×PU(J)
PDX(J) ← (1−SA)×PDX(J) + SA×PD(J)
J ≧ 3 ?
NO
145
YES
YES
J ≧ 3 ?
149
NO
J ← J+1
150
EXIT
95

CONTROL APPARATUS FOR ELEVATORS

BACKGROUND OF THE INVENTION

This invention relates to a control apparatus for elevators in which cages are controlled on the basis of a demand for the elevators or the service condition value of the elevators for the demand.

The traffic volume of elevators in a building (hereinbelow, termed "demand") fluctuates irregularly when closely observed within a period of one day, but presents similar aspects for the same time zones when observed over several days.

In, for example, an office building, elevator passengers on their way to their office floors crowd on the first floor during a short period of time in the time zone in which they attend offices in the morning. In the first half of the lunch hour, many passengers go from the office floors to a restaurant floor, while in the latter half thereof, many passengers go from the restaurant floor and the first floor to the office floors. Further, many passengers go from the office floors to the first floor in the time zone in which they leave the offices in the evening. The volumes of traffic in the up direction and in the down direction are nearly equal in the daytime time zones other than mentioned above, while the volume of traffic becomes very small throughout the nighttime.

In order to deal with the traffic in the building changing in this manner by means of a limited number of elevators, the elevators are usually operated under group supervision. One of the important roles of the group supervision of the elevators is to assign an appropriate elevator to each hall call registered. Various assignment systems for the hall calls have been proposed. By way of example, there has been considered a system wherein, when a hall call is registered anew, it is tentatively assigned to respective elevators, and the waiting times of all hall calls, the possibility of the full capacity of passengers, etc. are predicted to calculate service evaluation values for all the cases, from among which the appropriate elevator is selected. In order to execute such predictive calculations, traffic data peculiar to each building is required. For example, data on the number of passengers who get on and off the cage of each elevator at intermediate floors is required for predicting the possibility of the full capacity. When such traffic data which changes every moment is stored each time, an enormous memory capacity is necessitated, which is not practical. It is therefore common practice to reduce the required memory size by dividing the operating period of time in one day into several time zones and storing only the average traffic volumes of the respective time zones. Soon after the completion of the building, however, there is a high possibility that the traffic data will change in accordance with changes in personnel organization in the building, and hence, it is difficult to obtain good traffic data with which the demand can be predicted accurately. For this reason, there has been thought out a system wherein traffic conditions in the building are detected so as to sequentially improve traffic data.

More specifically, the operating period of time in one day is divided into K time zones (hereinbelow, termed "sections"), and a time (hereinbelow, termed "boundary") by which a section $k-1$ and a section k are bounded is denoted by $t_k$ ($k=2, 3, \ldots K$). Times $t_1$ and $t_{k+1}$ are the starting time and end time of the elevator operation, respectively. The average traffic volume $P_k(l)$ of the section k on the l-th day is supposed to be given by the following equation (1):

$$P_k(l) = \frac{1}{t_{k+1} - t_k} \begin{bmatrix} X_k^u(l) \\ X_k^d(l) \\ Y_k^u(l) \\ Y_k^d(l) \end{bmatrix} \tag{1}$$

Here, $X_k^u(l)$ is a column vector of $(F-1)$ dimensions (where F denotes the number of floors) the elements of which are the number of passengers to get on cages in the up direction at the respective floors in the time zone k of the l-th day. Similarly, $X_k^d(l)$, $Y_k^u(l)$ and $Y_k^d(l)$ are column vectors which indicate the number of passengers to get on the cages in the down direction, the number of passengers to get off the cages in the up direction and the number of passengers to get off the cages in the down direction, respectively. The average traffic volume $P_k(l)$ (hereinbelow, termed "average demand") is measured by a passenger-number detector which utilizes load changes during the stoppage of the cages of the elevators and/or industrial television, ultrasonic wave, or the like.

First, it will be considered to sequentially correct the representative value of the average demand $P_k(l)$ of each time zone in a case where the boundary $t_k$ which is the time zone demarcating time is fixed.

It is thought that the columns $\{P_k(1), P_k(2), \ldots\}$ of the average demands occurring daily will disperse in the vicinity of a certain representative value $P_k$. Since the magnitude of the representative value $P_k$ is unknown, it needs to be estimated by any method. In this case, there is the possibility that the magnitude itself of the representative value $P_k$ will change. The representative value is therefore predicted by taking a linear weighted average given in equations (2) and (3) below and attaching more importance to the average demand $P_k(l)$ measured latest, than to the other average demands $P_k(1)$, $P_k(2)$, . . . and $P_k(l-1)$.

$$\hat{P}_k(l) = (1-a)^l P_k(O) + \sum_{i=1}^{l} \lambda_i P_k(i) \tag{2}$$

$$\lambda_i = a(1-a)^{l-i} \tag{3}$$

Here, $\hat{P}_k(l)$ is the representative value which has been predicted from the average demands $P_k(1), \ldots$ and $P_k(l)$ measured till the l-th day, and $P_k(O)$ is an initial value which is set to a suitable value and is set in advance. $\lambda_i$ denotes the weight of the average demand $P_k(i)$ measured on the i-th day, and this weight changes depending upon a parameter a. More specifically, an increase in the value of the parameter a results in an estimation in which more importance is attached to the latest measured average demand $P_k(l)$ than to the other average demands $P_k(1), \ldots$ and $P_k(l-1)$, and in which the predictive representative value $\hat{P}_k(l)$ quickly follows up the change of the representative value $P_k$. However, when the value of the parameter a is too large, it is feared that the predictive representative value will change too violently in a manner to be influenced by the random variations of daily data. Meanwhile, equations (2) and (3) can be rewritten as follows:

$$\hat{P}_k(l) = (1-a)\hat{P}_k(l-1) + a\,P_k(l) \tag{4}$$

$$\hat{P}_k(O)=P_k(O) \quad (5)$$

In accordance with the above equation (4), there is the advantage that the weighted average of equation (2) can be calculated without storing the observation values $P_k(i)(i=1, 2, \ldots, l-1)$ of the average demands in the past.

On a day such as Sunday or a national holiday on which the traffic volume differs from the ordinary value, however, whether or not the measured result of the traffic demand is used for the calculation of the estimative value of the demand can be determined in each time zone, but the estimated value of the demand obtained till the preceding day is inevitably used in the predictive calculation of the waiting time, the possibility of the full capacity of passengers, or the like in the particular time zone. This has led to the disadvantage that the predictive calculation becomes erroneous, so the elevators are not group-supervised in conformity with the traffic condition of the day such as Sunday or a national holiday.

Besides the traffic demand referred to above, such as the numbers of passengers getting on or off the cages or the number of hall calls; data expressive of a service condition such as waiting times on the halls, ride times in the cages, the number of times of passage due to the full capacity or the correct rate of prediction is considered as data for use in the group supervision etc. Also in case of group-supervising the elevators with such data, a similar drawback will arise.

SUMMARY OF THE INVENTION

This invention has been made in view of the drawbacks described above, and has for its object to provide a control apparatus for elevators in which one cycle of a fluctuating demand is divided into a plurality of sections, the demand in each section or a service condition value of the elevators for the demand is measured, the demand or the service condition value of the corresponding section is estimated from the measured value, and decision means is comprised to compare the estimated value and the measured value obtained anew and to decide the compared result, so that when the compared result has been decided to fail in satisfying a reference condition, cages are controlled with a value set separately from the estimated value or a value separately calculated for estimation, whereby even when the measured value has become different from an ordinary value due to the occurrence of a special traffic condition, it is prevented from being used in the calculation of the estimative value, so as to permit an accurate estimation when an ordinary traffic condition has been thereafter restored.

BRIEF DESCRIPTION OF THE DRAWINGS

FIGS. 3 to 10 show an embodiment of this invention, in which:

FIG. 3 is a block diagram showing a whole elevator system;

FIG. 4 is a memory map diagram of a random access memory;

FIG. 5 is a memory map diagram of a read-only memory;

FIG. 6 is a diagram showing the general flow of programs;

FIG. 7 is a flow chart of an initializing program;

FIG. 8 is a flow chart of an up direction demand calculating program;

FIG. 9 is a flow chart of a deciding program as well as an average demand estimating program; and FIG. 10 is a flow chart of an output program.

DESCRIPTION OF THE PREFERRED EMBODIMENT

Referring now to FIGS. 1 to 10, an embodiment of this invention will be described in connection with a demand which is expressed in two dimensions.

Figure 1:
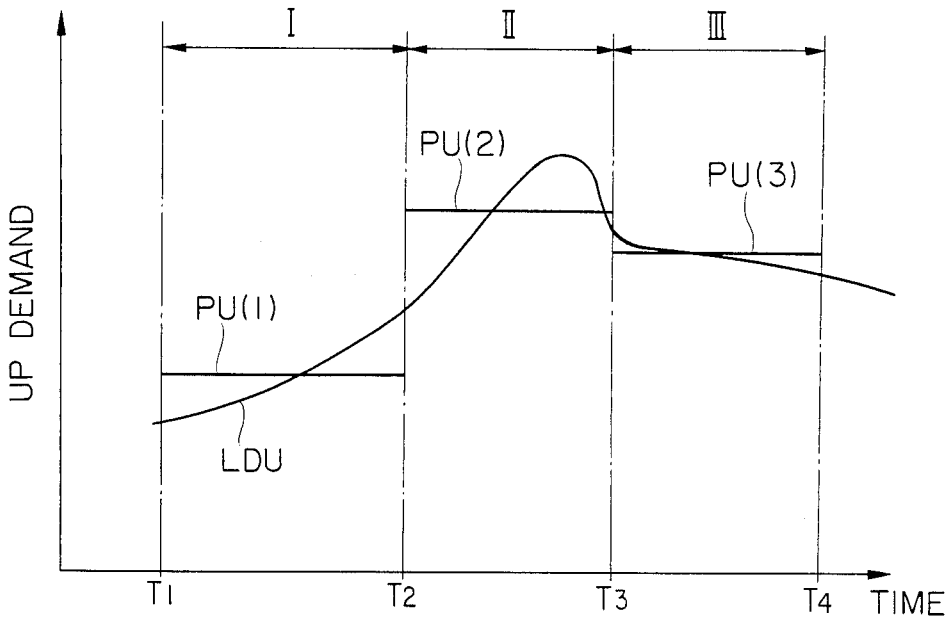
FIGS. 1 and 2 are explanatory diagram showing the fluctuations of traffic condition values concerning elevators.
Figure 2:
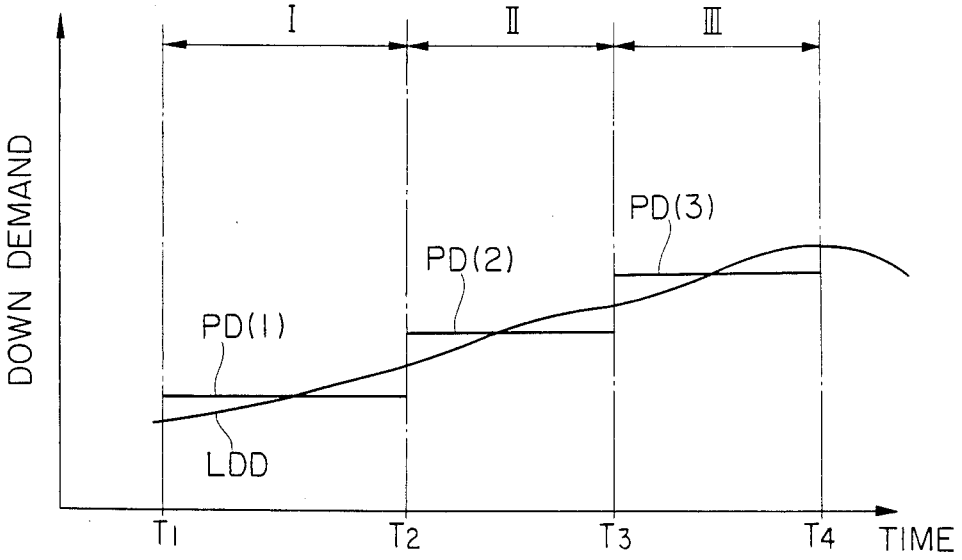

First, FIGS. 1 and 2 illustrate demands in the form of the numbers of persons who move in the up direction and down direction within a building, respectively. LDU indicates the up direction demand which is obtained in such a way that the numbers of persons moving in the up direction at predetermined times are measured and totaled for all floors, whereupon, the total values are cumulated every unit time DT (set at 5 minutes). Similarly, the down direction demand LDD is obtained in such a way that the numbers of persons moving in the down direction at predetermined times are measured and totaled for all the floors, whereupon the total values are cumulated every unit time DT. T1 denotes the boundary which is the starting time of a section I, T2 the boundary between the section I and a section II, and T3 the boundary between the section II and a section III. PU(1) and PD(1) designate an average up direction demand and an average down direction demand in the section I, respectively. They correspond to the average traffic volume $P_k(l)$ resulting when values obtained by cumulating the up direction demand LDU and the down direction demand LDD in the section I are respectively substituted into the column vectors $X_k^u(l)$ and $X_k^d(l)$ in equation (1), and the column vectors $Y_k^u(l)=0$ and $Y_k^d(l)=0$ are assumed. PU(2) and PD(2), and PU(3) and PD(3) similarly designate an average up directiom demand and an average down direction demand in the section II, and an average up direction demand and an average down direction demand in the section III, respectively.

Figure 3:
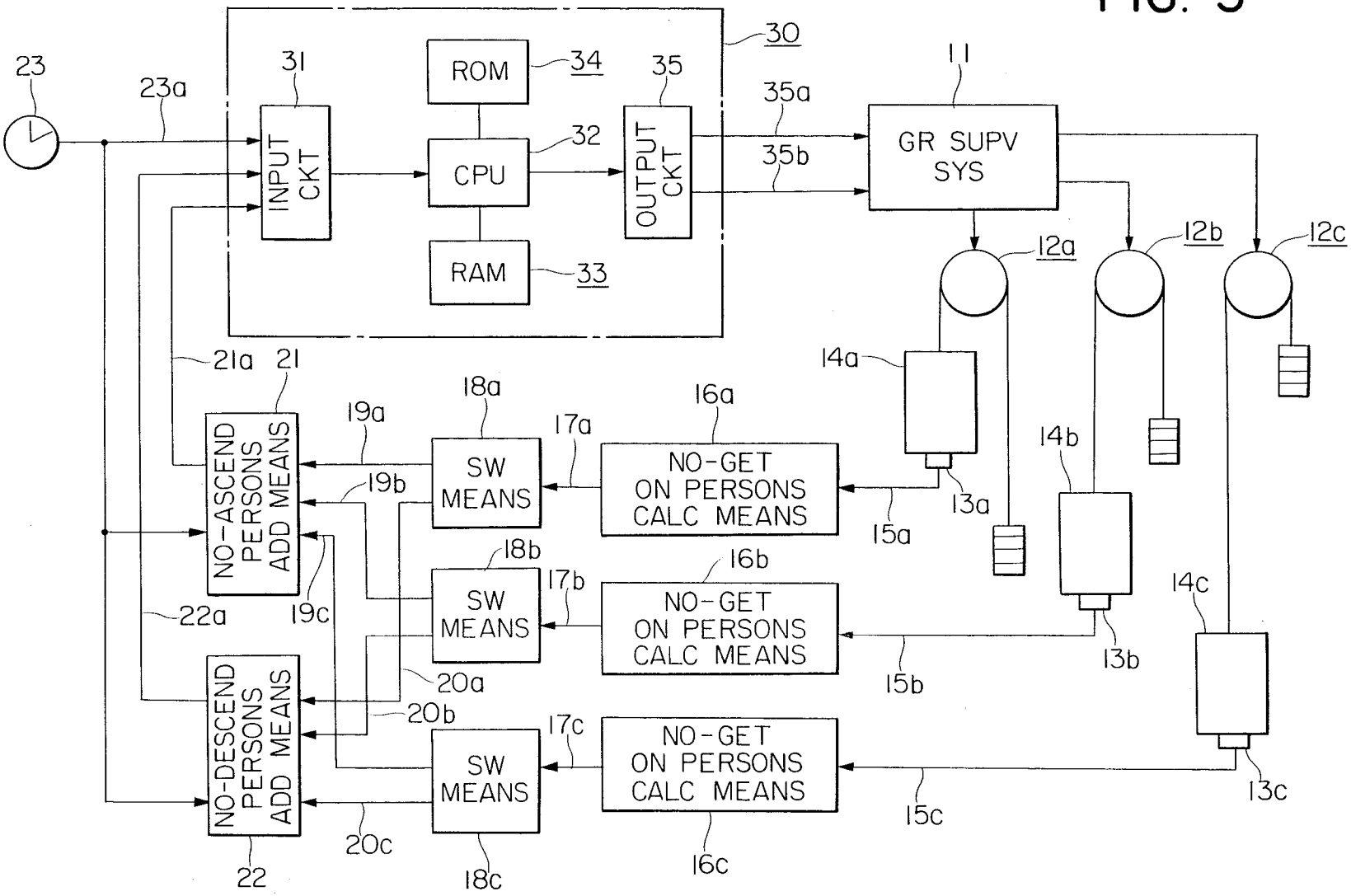

Referring now to FIG. 3, numeral 11 designates a group supervisory system which group-supervises three elevators 12*a*, 12*b* and 12*c*. Symbols 13*a*, 13*b* and 13*c* designate number-of-persons detection means which are constructed of well-known weighing devices disposed under the floors of the cages 14*a*, 14*b* and 14*c* of the elevators 12*a*, 12*b* and 12*c*, respectively. They provide number-of-persons signals 15*a*, 15*b* and 15*c* proportional to the actual numbers of passengers, respectively. Symbols 16*a*, 16*b* and 16*c* indicate number-of-getting on persons calculation means for calculating the numbers of persons who have gotten on the cages 14*a*, 14*b* and 14*c*, as disclosed in, e.g., the official gazette of U.S. Pat. No. 4,044,860. They detect the minimum values of the respective number-of-persons signals 15*a*, 15*b* and 15*c* at the times when doors (not shown) are open. Further, they subtract the minimum values of the number-of-persons signals 15*a*, 15*b* and 15*c* from the number-of-persons signals 15*a*, 15*b* and 15*c* immediately before the cages 14*a*, 14*b* and 14*c* start upon the closure of the doors, thereby to provide number-of-getting on persons signals 17*a*, 17*b* and 17*c*, respectively. Switching means 18*a*, 18*b* and 18*c* deliver the number-of-getting on persons signals 17*a*, 17*b* and 17*c* to signal lines 19*a*, 19*b* and 19*c* while the elevators 12*a*, 12*b* and 12*c* are continuing ascent operations, and they deliver these signals to signal lines 20*a*, 20*b* and 20*c* while the elevators are continuing descent operations, respectively. Numbers-of-ascending persons addition means 21 adds the respective number-of-getting on persons signals 17*a*, 17*b* and 17*c* inputted by the signal lines 19*a*, 19*b* and 19*c* and cumulates them for the unit time DT, and it provides an up-direction number-of-passengers signal 21*a* obtained by the cumulation. Numbers-of-descending persons addition means 22 adds the respective number-of-getting on persons signals 17*a*, 17*b* and 17*c* inputted by the signal lines 20*a*, 20*b* and 20*c* and cumulates them for the unit time DT, and it provides a down-direction number-of-passengers signal 22*a* obtained by the cumulation. Clock means 23 produces a timing signal 23*a* each time the unit time DT lapses, thereby to reset the up-direction number-of-passengers signal 21*a* and the down-direction number-of-passengers signal 22*a* to zero. Shown at numeral 30 is control means constructed of an electronic computer such as microcomputer. It comprises an input circuit 31 which is constructed of a converter for receiving the up-direction number-of-passengers signal 21*a*, the down-direction number-of-passengers signal 22*a* and the timing signal 23*a*; a central processing unit 32 which operates and processes the respective signals received by the input circuit 31; a random access memory (hereinbelow, termed "RAM") 33 which stores data such as the operated results of the central processing unit (hereinbelow, termed "CPU") 32; a read only memory (hereinbelow, termed "ROM") 34 which stores programs, constant value data, etc.; and an output circuit 35 which is constructed of a converter for delivering signals from the CPU 32. Signal lines 35*a* and 35*b* transmit the signals of the output circuit 35 to the group supervisory system 11, respectively.

FIG. 4 shows the content of the RAM 33. Referring to the figure, numeral 41 indicates a memory area in which a time TIME obtained from the timing signal2 23*a* is stored. A memory area 42 stores as the up direction demand LDU the accepted up-direction number-of-passengers signal 21*a*, while a memory area 43 stores as the down direction demand LDD the accepted down-direction number-of-passengers signal 22*a*. A memory area 44 stores a counter J which is used as a variable indicative of any of the sections I–III. A memory area 45 stores a distance X which is used as a variable expressive of the extent of the similarity between the estimated average demand and the measured average demand for each section. A memory area 46 stores a flag FLAG which is set at 1 (one) when it has been detected that the measured value of the demand differs from a magnitude on an ordinary day. Memory areas 47–49 store the average up direction demands PU(1-)–PU(3) in the sections I–III, respectively, while memory areas 50–52 store the average down direction demands PD(1)–PD(3) in the sections I–III, respectively. Memory areas 53–55 store predicted average up direction demands PUL(1)–PUL(3) on the ordinary day, which correspond to representative values $P_k(l)$ obtained by substituting the average up direction demands PU(1)–PU(3) into equation (4), respectively, while memory areas 56–58 store predicted average down direction demands PDL(1)–PDL(3) on the ordinary day, which correspond to representative values $P_k(l)$ obtained by substituting the average down direction demands PD(1)–PD(3) into equation (4), respectively. Memory areas 59–61 store predicted average up direction demands PUX(1)–PUX(3) on a special day such as holiday, which correspond to representative values $\hat{P}_k(l)$ obtained by substituting the average up direction demands PU(1)–PU(3) into equation (4), respectively, while memory areas 62–64 store predicted average down direction demands PDX(1)–PDX(3) on the special day such as holiday, which correspond to representative values $\hat{P}_k(l)$ obtained by substituting the average down direction demands PD(1)–PD(3) into equation (4), respectively.

FIG. 5 shows the content of the ROM 34. Referring to the figure, numerals 71–74 designate memory areas in which the boundaries T1–T4 set at 85 (=7:0.5), 99 (=8:15), 108 (=9:00) and 122 (=10:10) are stored, respectively. A memory area 75 store a weight coefficient SA which corresponds to the parameter a in equation (4) and which is set at 0.2. In a memory area 76, the reference value L for deciding the distance X is set at 400. Memory areas 77–79 store the initial values PU1–PU3 of the predictive average up-direction demands PUL(1)–PUL(3), which are set at 65 (passengers/5 minutes), 130 (passengers/5 minutes) and 109 (passengers/5 minutes), respectively. Memory areas 81–82 store the initial values PD1–PD3 of the predictive average down-direction demands PDL(1)–PDL(3), which are set at 5 (passengers/5 minutes), 7 (passengers/5 minutes) and 20 (passengers/5 minutes), respectively. Memory areas 83–85 store the initial values (or standard values) PU1X–PU3X of the predictive average up-direction demands PUX(1)–PUX(3) on the special day such as holiday, which are set at 20 (passengers/5 minutes), 30 (passengers/5 minutes) and 35 (passengers/5 minutes), respectively. Memory areas 86–88 store the initial values (or standard values) PD1X–PD3X of the predictive average down-direction demands PDX(1)–PDX(3) on the special day such as holiday, which are set at 3 (passengers/5 minutes), 4 (passengers/5 minutes) and 5 (passengers/5 minutes), respectively.

Figure 6:
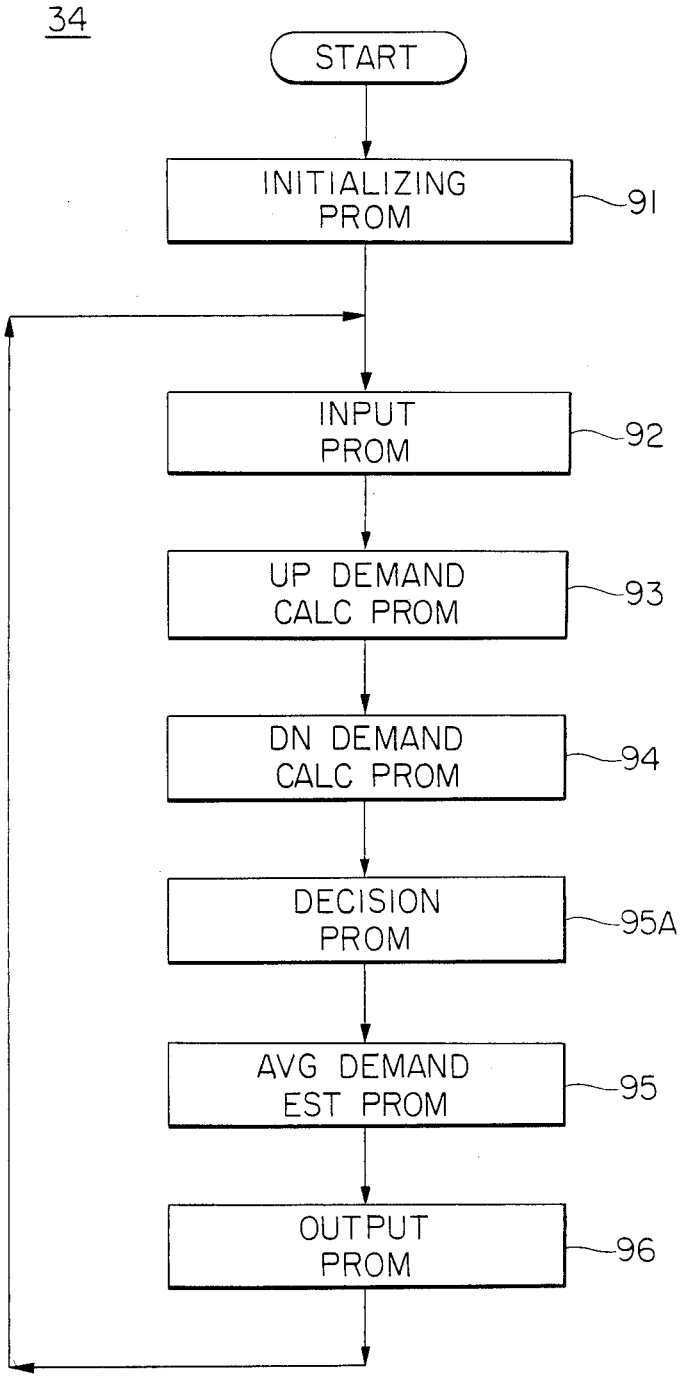
Figure 7:
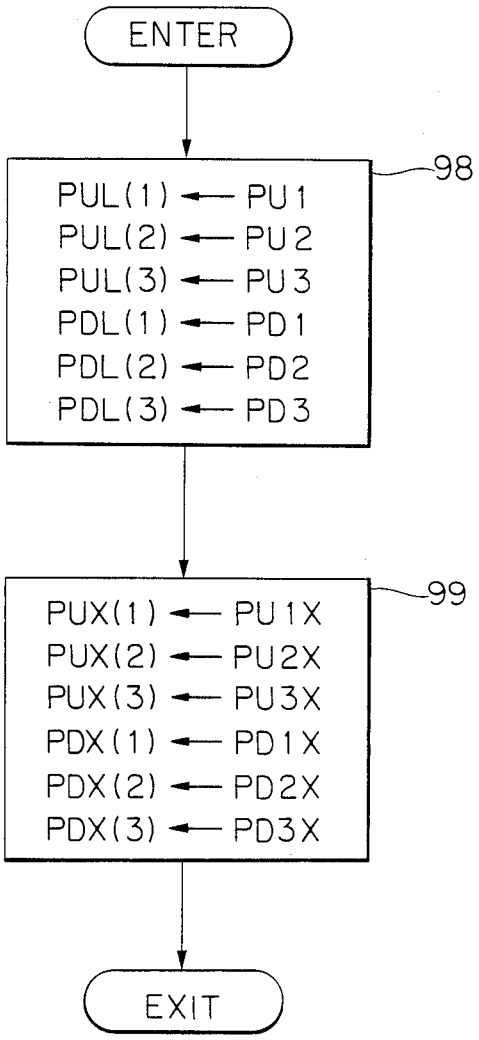

FIG. 6 illustrates the general flow of programs which are stored in the ROM 34 in order to estimate the average demand. Referring to the figure, numeral 91 designates an initializing program for setting the initial values of various data. An input program 92 accepts signals from the input circuit 31 and sets them in the RAM 33. An up demand calculating program 93 calculates the average up-direction demands PU(1)–PU(3) measured in the respective sections I–III, while a down demand calculating program 94 calculates the average down-direction demands PD(1)–PD(3) similarly to the above. A decision program 95A decides if the calculated average demands PU(1)–PU(3) and PD(1)–PD(3) differ from ordinary magnitudes. An average demand estimating program 95 calculates the predictive average up-direction demands PUL(1)–PUL(3) and PUX(1)–PUX(3) and predictive average down-direction demands PDL(1)–PDL(3) and PDX(1)–PDX(3) in the respective sections I–III. An output program 96 transmits the predictive average up-direction demands PUL(1)–PUL(3) and PUX(1)–PUX(3) and predictive average down-direction demands PDL(1)–PDL(3) and PDX(1)–PDX(3) from the output circuit 35 to the group supervisory system 11 through the signal lines 35*a* and 35*b*, respectively.

The operations of the demand estimation apparatus constructed as thus far described will be described.

First, the numbers of persons who have gotten on the cages 14*a*–14*c* are respectively calculated by the number-of-getting on persons calculation means 16a–16c. Among these numbers of persons, the numbers concerning the ascent operations are applied to the numbers-of-ascending persons addition means 21, and the numbers concerning the descent operations are applied to the numbers-of-descending persons addition means 22, in such a manner that the number-of-getting on persons signals 17a–17c are switched by the switching means 18a–18c. The respective numbers of the persons who have gotten on the cages are added, whereupon the up-direction number-of-passengers signal 21a and down-direction number-of-passengers signal 22a are provided and sent to the input circuit 31. Besides, the number of counts produced when the value 1 (one) is counted every 5 minutes since a time 0 (zero) o'clock is provided as the timing signal 23a from the clock means 23, and it is sent to the input circuit 31.

On the other hand, when the control device 30 is first connected to a power source (not shown), the initializing program 91 is, actuated. More specifically, as illustrated in detail in FIG. 7, at Steps 98 and 99, the initial values PU1–PU3 and PU1X–PU3X are respectively set for the predictive average up-direction demands PUL(1)–PUL(3) and PUX(1)–PUX(3), and the initial values PD1–PD3 and PD1X–PD3X are respectively set for the predictive average down-direction demands PDL(1)–PDL(3) and PDX(1)–PDX(3). Then, the control flow shifts to the input program 92.

The input program 92 is a well-known program which feeds the input signal from the input circuit 31 into the RAM 33. By way of example, when the time is 8 o'clock, the input program reads the value 96 from the input circuit 31 and shifts it to the memory area 41 so as to set the time TIME at 96. Likewise, the up-direction number-of-passengers signal 21a is accepted and stored as the up direction demand LDU, while the down-direction number-of-passengers signal 22a is accepted and stored as the down direction demand LDD.

Figure 8:
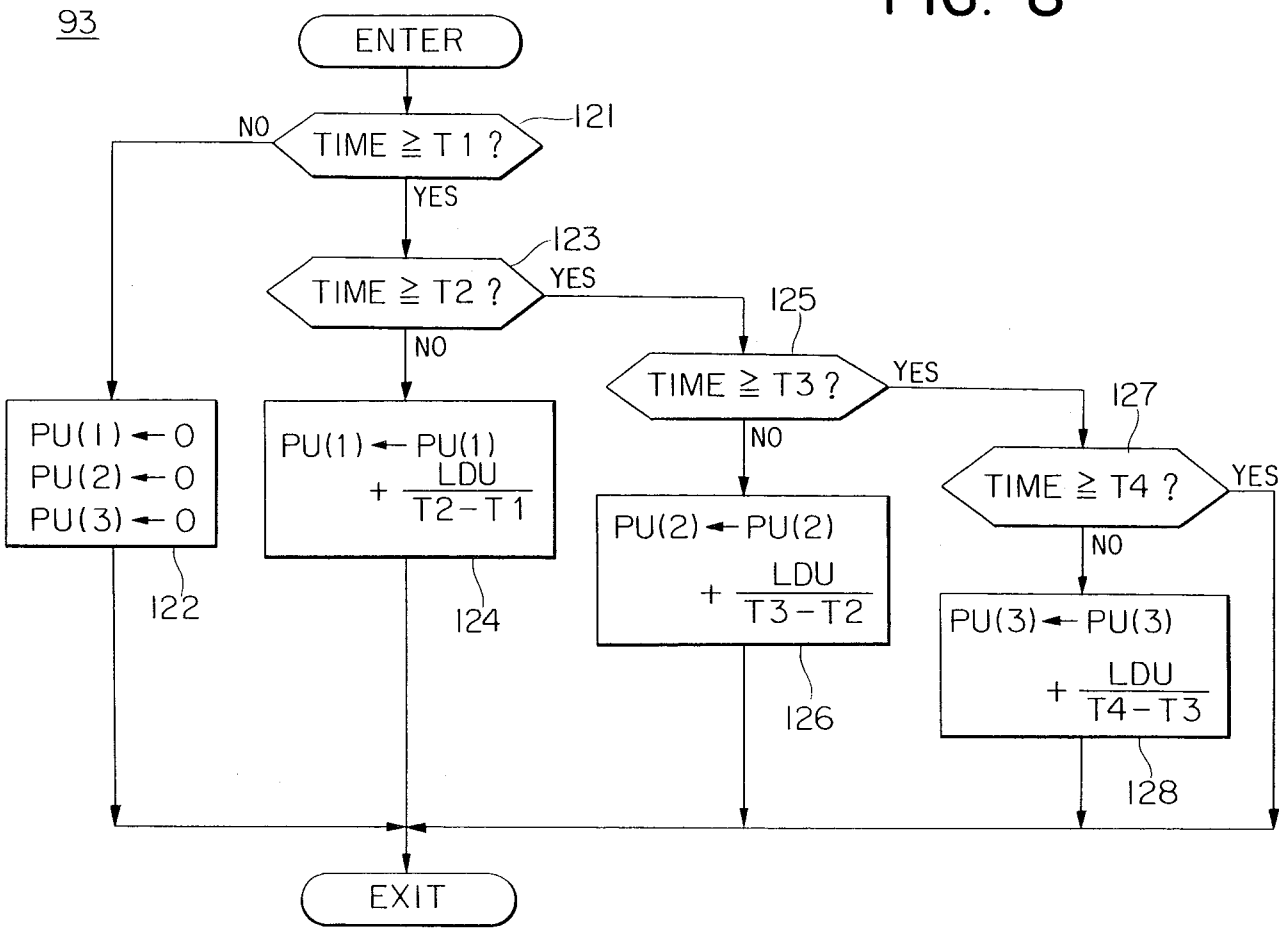

Next, the operations of the up demand calculating program 93 will be explained with reference to FIG. 8.

At Step 121, it is decided whether or not the time zone in which the average demand is to be calculated has been reached. When the time TIME is smaller than the boundary T1, the control flow proceeds to Step 122, at which all the average up-direction demands PU(1)–PU(3) are set at 0 (zero) as the initializing operation for the calculation of the average demand. When the time TIME becomes equal to or greater than the boundary T1 at Step 121, the control flow proceeds to Step 123. When the time TIME is smaller than the boundary T2 here, the control flow proceeds to Step 124, at which the average up-direction demand PU(1) of the section I is corrected by the use of the up direction demand LDU measured anew, so as to increase to the amount of the up direction demand per unit time DT as denoted by LDU/(T2−T1). When the time TIME is $T2 \leqq TIME < T3$, the control flow proceeds along Steps 123→125→126, at which the average up-direction demand PU(2) of the section II is corrected in the same manner as at Step 124. Further, if the time TIME is $T3 \leqq TIME < T4$, the control flow proceeds along Step 125→127→128, at which the average up-direction demand PU(3) of the section III is corrected in the same manner as at Step 124.

In this way, the average up-direction demands PU(1)–PU(3) of the sections I–III are sequentially corrected in the up demand calculating program 93.

Next, the operations of the down demand calculating program 94 will be described.

The down demand calculating program 94 is a program which sequentially corrects the average down-direction demands PD(1)–PD(3) of the sections I–III likewise to the up demand calculating program 93. Therefore, it is readily understood from the up demand calculating program 93 stated above and shall not be explained more.

Figure 9:
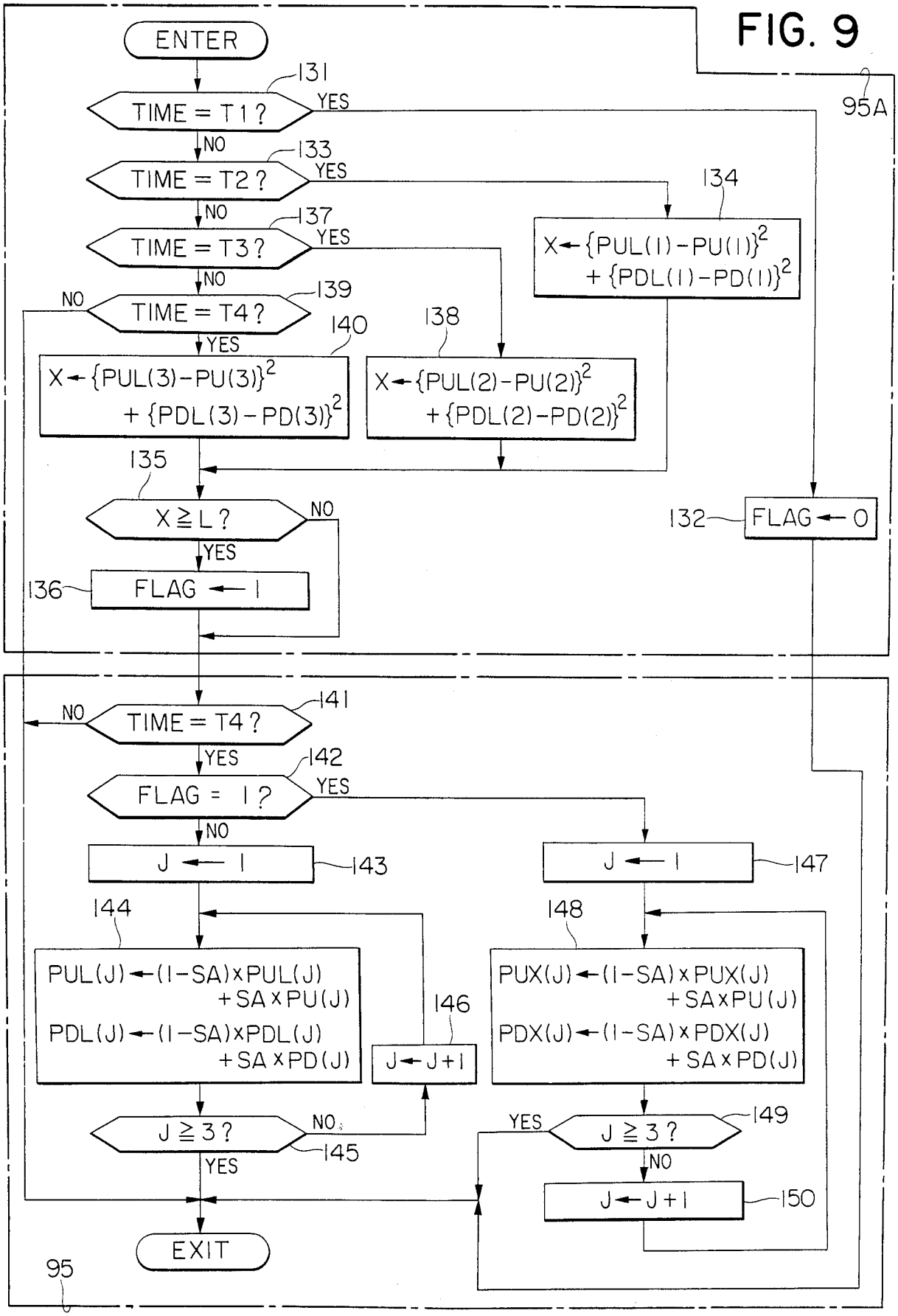

Next, the decision program 95A and the average demand estimating program 95 will be described with reference to FIG. 9.

First, regarding the decision program 95A, when the time TIME has agreed with the boundary T1 which is the starting time of the section I, Step 131 proceeds to Step 132, at which the flag FLAG is initialized to 0 (zero) for the succeeding decision. When the time TIME has agreed with the boundary T2 which is the end time of the section I (namely, the starting time of the section II), the control flow proceeds along Steps 131→133→134, which calculates the distance X for assessing to what extent the average demands PU(1) and PD(1) measured in the section I are similar to the predicted average demands PUL(1) and PDL(1) in the section I on the ordinary day. For example, in a case where the average demands PU(1) and PD(1) are 70 (passengers/5 minutes) and 7 (passengers/5 minutes) respectively and where the predicted average demands PUL(1) and PDL(1) are set at 60 (passengers/5 minutes) and 10 (passengers/5 minutes) respectively, the distance X is calculated as $X=(60-70)^2+(10-7)^2=109$. At the next Step 135, the distance X and the reference value L are compared. In the case of the distance X=109 as mentioned above, it is decided to be smaller than the reference value L (=400), and hence, the control flow proceeds directly to Step 141 of the average demand estimating program 95. In contrast, in a case where the average demands PU(1) and PD(1) have been respectively measured as 30 (passengers/5 minutes) and 2 (passengers/5 minutes) by way of example, the distance $X=(60-30)^2+(10-2)^2=964>$ reference value L (=400) holds, and hence, the control flow proceeds to Step 136. Here, the flag FLAG is set at 1 (one) in order to express that the demand measured on the particular day differs in magnitude from the demand on the ordinary day. When the time TIME agrees with the boundary T3 which is the end time of the section II, the control flow proceeds along Steps 133→137→138, and when the time TIME agrees with the boundary T4 which is the end time of the section III, the control flow proceeds along Steps 133→137→139→140. Then the distance X is calculated as in the case of the section I, to be compared with the reference value L. In this manner, whether or not the measured average demands are similar to the predicted average demands on the ordinary day is decided at the boundaries T2–T4 which are the end times of the respective sections I–III.

Secondly, regarding the average demand estimating program 95, Step 141 checks if the time TIME agrees with the boundary T4 which is the end time of the section III. Only in case of the agreement, either the succeeding Steps 142–146 or 142, 147–150 are executed. When all the measured average demands of the sections I–III have been decided the average demands of the ordinary day, that is, when the flag FLAG=0 holds, the control flow proceeds along Steps 141→142→143, at which the counter J is initialized to 1 (one). At Step 144, the predictive average up-direction demand PUL(J) of the ordinary day calculated till the preceding day is multiplied by (1 − SA) and is added to the average up-direction demand PU(J) just measured on the particular day as multiplied by SA, to set a predictive average up-direction demand PUL(J) anew. Likewise, the predictive average down-direction demand PDL(J) is set again. Each time the predictive average demands PUL(J) and PDL(J) are thus calculated, the counter J is increased by 1 (one), whereupon the calculations of Steps 144–146 are repeated. When the calculations have been executed to the section III, J=3 holds, and the control flow proceeds from Step 145 to an exit.

On the other hand, when any of the measured average demands of the sections I–III has been decided the average demand of the special day different from the ordinary day, that is, when the flag FLAG=1 holds, the control flow proceeds along Steps 141→142→147, at which the counter J is initialized to 1 (one). At Steps 148–150, the predictive average up-direction demand PUX(J) and predictive average down-direction demand PDX(J) on the special day are set again for each of the sections I–III similarly to Steps 144–146.

In this way, according to the average demand estimating program 95, the predictive average demands of the ordinary day or the special day are updated every day with the average demands measured for each section.

Figure 10:
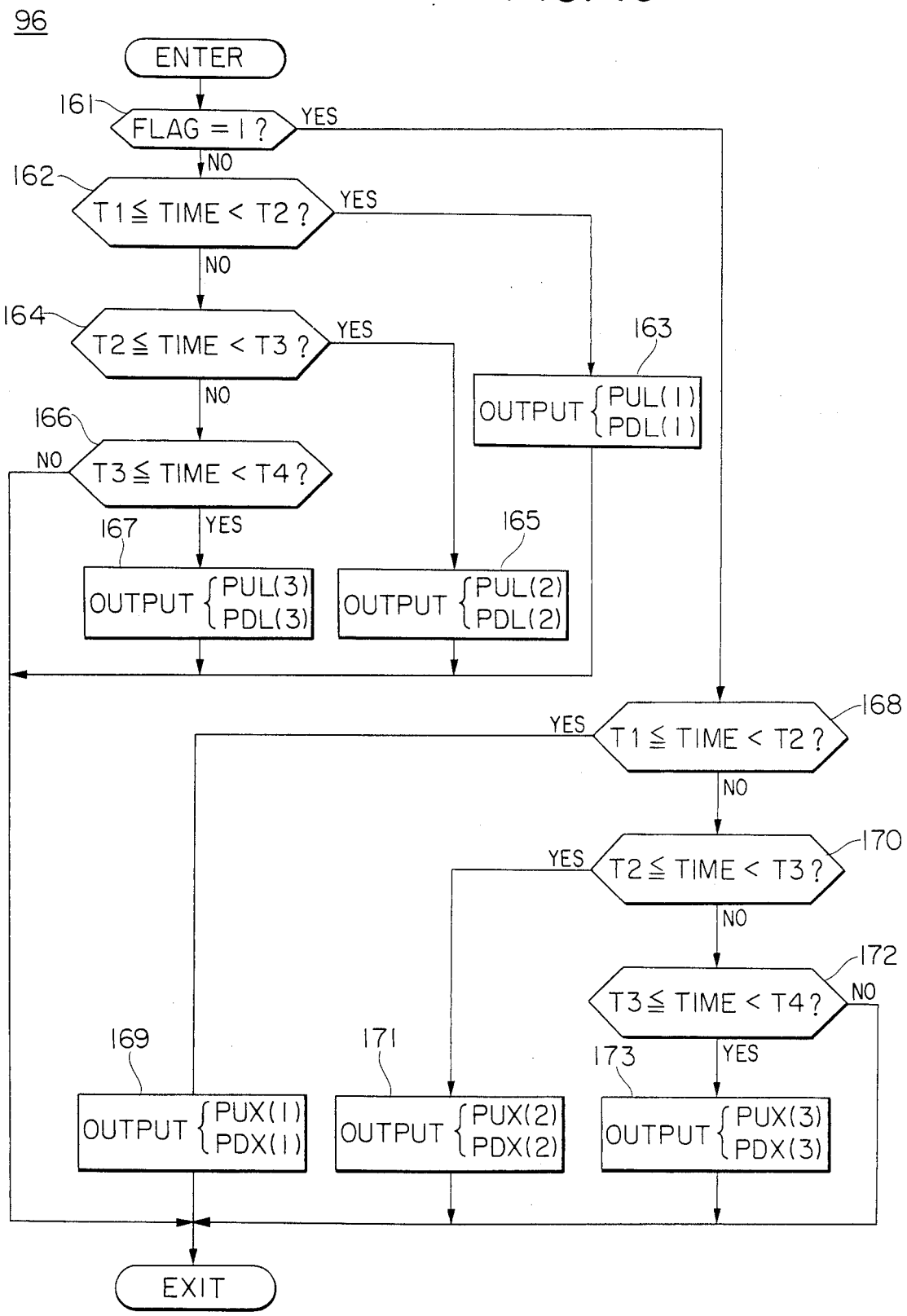

The predicted average up-direction demands PUL(1)–PUL(3) or PUX(1)–PUX(3) and predicted average down-direction demands PDL(1)–PDL(3) or PDX(1)–PDX(3) in the respective sections I–III as calculated in the way described above are transmitted from the output circuit 35 via the signal lines 35*a* and 35*b* to the group supervisory system 11 by the output program 96 shown in FIG. 10.

First, in the section I (T1≦TIME<T2), the flag FLAG is set at 0 (zero) without fail, and hence, the control flow proceeds along Steps 161→162→163. Here, the predicted average up-direction demand PUL(1) on the ordinary day is delivered from the output circuit 35 onto the signal line 35*a*, and the predicted average down-direction demand PDL(1) is similarly delivered onto the signal line 36*a*.

Next, it is supposed by way of example that the average demands PU(1) and PD(1) measured in the section I have been decided the average demands of the special day different from the ordinary day, by the average demand estimating program 95 at the time TIME=the boundary T2. Then, since the flag FLAG=1 holds in the section II (T2≦TIME<T3) and section III (T3≦TIME<T4), the control flow proceeds along Steps 161→170→171 and Steps 161→168→170→172→173, respectively. At the respective Steps 171 and 173, the predicted average up-direction demands PUX(2) and PUX(3) of the special day are delivered from the output circuit 35 onto the signal line 35*a*, and the predicted average down-direction demands PDX(2) and PDX(3) are similarly delivered onto the signal line 36*a*.

When the average demands PU(1), PD(1) and PU(2), PD(2) measured in the section I and section II have been decided the average demands of the ordinary day by the average demand estimating program 95, the flag FLAG is 0 (zero). Therefore, the control flow proceeds along Steps 161→162→164→165 for the section II, and it proceeds along Steps 161→162→164→166→167 for the section III. At the respective Steps 165 and 167, the predicted average demands PUL(2), PDL(2) and PUL(3), PDL(3) of the ordinary day are delivered.

In this way, according to the output program 96, the predicted average demands are delivered to the group supervisory system 11 in accordance with the result of the decision on whether the particular day is the ordinary day or the special day.

In this fashion, according to the embodiment, the average demand measured on the particular day is compared with the predictive average demand of the ordinary day, the predictive average demand of the ordinary day is used for the group supervision while the particular day is decided the ordinary day, and the predictive average demand of the special day is used for the group supervision in sections following a section in which the particular day is decided the special day, so that the elevatos can be group-supervised as intended.

In the embodiment, the predictive average demand of the special day estimated from the average demand of only the day on which the measured average demand differs from the average demand of the ordinary day is separately calculated, and the predicted average demand is used for the group supervision on the special day. However, a similar effect is achieved even when standard values PU1X–PU3X and PD1X–PD3X set for the special day and stored in the ROM 34 in advance are used for the group supervision.

Although, in the embodiment, the case has been described where the fluctuating aspects of the demand consist only of the two of the ordinary day and the special day, this invention is of course applicable to a case where three or more fluctuating aspects are involved.

Further, it is apparent from the foregoing embodiment that this invention is also applicable to a case of predicting demands in four or more sections or a case of predicting demands for respective floors (in individual directions).

With the embodiment, when the particular day has been decided to differ from the ordinary day even in one section, the predictive average demands of the special day are used for the group supervision in the succeeding sections. However, the condition under which the predictive average demands of the ordinary day are discarded is not restricted thereto. For example, in a case where such sections whose demands have been decided to differ from those of the ordinary day have continued or intermittently occurred a plurality of times, or in a case where the number of such sections has reached a predetermined value, the predictive average demands of the ordinary day may be thereafter discarded. In addition, in a case where the special day different from the ordinary day, such as a national holiday or the beginning or end of the year, is known beforehand, the operator can externally appoint the elevator operation with a switch or the like so as to discard the predictive average demand of the ordinary day.

The control data for use in the group supervision is not restricted to the estimative value of the average demand mentioned above, but it may well be the average number of calls, or the average waiting time, the average maximum waiting time, the average number of times of passage due to the full capacity of passengers, or the like expressive of a service condition.

As set forth above, according to this invention, one cycle of a fluctuating demand is divided into a plurality of sections, the demand in each section or a service condition value of elevators for the demand is measured, the demand or the service condition value of the corresponding section is estimated from the measured value, and decision means is comprised to compare the estimated value and the measured value obtained anew and to decide the compared result, so that when the compared result has been decided to fail in satisfying a reference condition, cages are controlled with a value different from the estimated value. This brings forth the effect that, even when the measured value has become different from an ordinary value due to the occurrence of a special traffic condition, it is not used for the calculation of the estimative value, so as to permit an accurate estimation when an ordinary traffic condition has been thereafter restored.

What is claimed is:

1. A control apparatus for elevators wherein a plurality of previous cycles and a present cycle of a fluctuating demand and/or service condition value are divided into a plurality of corresponding sections, wherein a first value indicative of an estimated demand and/or service condition value in at least one section of the present cycle is provided, said first value being estimated from the measured demand and/or service condition value of cycles previous to the present cycle, and wherein a second value indicative of a measured demand and/or service condition value in the one section of the present cycle is generated, said control apparatus comprising decision means for comparing the first value to the second value and determining if a reference condition is satisified, means for supplying as an output the first value if the reference condition is satisfied and a third value different from the first value if the reference condition is not satisfied, said third value being provided by said control apparatus, and means for controlling the elevator cages in accordance with the output.

2. A control apparatus for elevators as defined in claim 1, wherein the decision means includes means for providing a set value, means for generating a fourth value in accordance with the magnitude of the difference between the first and second values, and means for determining whether the set value is greater than the fourth value, the reference condition being thereby satisfied, or the set value is less than the fourth value, the reference condition being thereby not satisfied.

3. A control apparatus for elevators as defined in claim 2, wherein first and second values are generated for each section of the present cycle and wherein the decision means compares the first and second values and the output supplying means supplies an output for each of said plurality of sections in the present cycle.

4. A control apparatus for elevators as defined in claim 2, wherein the fourth value is generated in accordance with both the difference between the first and second values for an ascent direction of the elevator cages and the difference between the first and second values for a descent direction of the elevator cages.

5. A control apparatus for elevators as defined in claim 1 wherein the measured demand and/or service condition values for the section of the previous cycles corresponding to the one section of the present cycle include a first set which satisfied the reference condition and a second set which did not satisfy the reference condition and wherein the control apparatus further comprises an estimation means for generating the first and third values including a first calculation means for calculating the first value in accordance with the first set of values if the reference condition is satisfied and a second calculation means for calculating the third value in accordance with the second set of values if the reference condition is not satisfied, said third value being indicative of an estimated demand and/or service condition value.

6. A control apparatus for elevators as defined in claim 5, wherein said first calculation means updates the first value in accordance with the values of the first set to obtain the first value of the present cycle if the reference condition is satisfied.

7. A control apparatus for elevators as defined in claim 5, wherein said second calculation means updates the third value in accordance with the values of the second set to obtain the third value of the present cycle if the reference condition is not satisfied.

8. A control apparatus for elevators as defined in claim 1, wherein the decision means and the output means are realized by a digital system comprising a central processing unit (CPU) which receives and processes signals indicative of the demand and/or service condition value, a random access memory (RAM) which stores signals indicative of the demand and/or service condition value and results calculated by the CPU, and a read-only memory (ROM) which stores programs for operating the CPU and data values.

9. A control apparatus forr elevators as defined in claim 1, wherein the third value is a standard value set in advance and wherein said output supply means supplies the standard value when the decision means determines that the reference condition is not satisfied.

* * * * *